US006772981B1

(12) United States Patent
Yu

(10) Patent No.: US 6,772,981 B1
(45) Date of Patent: Aug. 10, 2004

(54) MUSICAL INSTRUMENT STAND

(76) Inventor: Ming-Ti Yu, 122-5, Jun Liao Rd. Feng Yuan, Taichung Hsien (TW)

( * ) Notice: Subject to any disclaimer, the term of this patent is extended or adjusted under 35 U.S.C. 154(b) by 0 days.

(21) Appl. No.: 10/336,776

(22) Filed: Jan. 2, 2003

(51) Int. Cl.[7] ..... G10G 5/00; G10D 3/00
(52) U.S. Cl. ..... 248/122.1; 84/327
(58) Field of Search ..... 248/125.1, 125.7, 248/163.1, 165, 170, 171, 172, 188.7, 125.3, 122.1; 403/109.4, 109.6, 170; 84/327, 453

(56) References Cited

U.S. PATENT DOCUMENTS 5,726,369 A * 3/1998 Gilday ..... 84/327
6,209,829 B1 * 4/2001 Yu ..... 248/122.1
6,323,405 B1 * 11/2001 Yu ..... 84/327

* cited by examiner

*Primary Examiner*—Ramon O. Ramirez
*Assistant Examiner*—Jon Szumny
(74) *Attorney, Agent, or Firm*—Charles E. Baxley

(57) ABSTRACT

A musical instrument stand has a joint, a leg support frame having a base bar and a first leg rod disposed on the base bar, the joint having a first tube connected to the first leg rod, a second tube connected to a second leg rod, and a third tube connected to a third leg rod, a main hollow rod disposed on the joint, and an upper rod. An end portion of the upper rod is inserted in the main hollow rod. A nut which is soldered on the main hollow rod has a threaded hole. A collar has a through hole, a protruded portion defining a slide channel, and a through aperture formed on the protruded portion. The through hole of the collar receives the main hollow rod. The slide channel of the collar receives the nut. The main hollow rod has a circular hole. A bracket has a shaft inserted in the circular hole of the main hollow rod.

9 Claims, 10 Drawing Sheets

MUSICAL INSTRUMENT STAND

BACKGROUND OF THE INVENTION

The present invention relates to a musical instrument stand. More particularly, the present invention relates to a musical instrument stand which can be folded easily.

U.S. Pat. No. 5,713,547 has disclosed a guitar stand which has a main hollow rod, a first hollow leg, a second hollow leg, a first brace, a second brace, a first bracket, and a second bracket. A pivot means fastens the first hollow leg and the second hollow leg on the main hollow rod pivotally. A hollow upper block is disposed on top of the main hollow rod. The pivot means has a lobe, a transverse plate and a longitudinal plate which is disposed on top of the transverse plate. A main hollow rod has a lobe disposed on an upper portion of the main hollow rod. A circular hole and a curved hole are formed on the main hollow rod. A hollow upper block has a lower protrusion inserted in an upper end of the main hollow rod. A first and a second round cushions are disposed adjacent to a first and a second sides of the hollow upper block, respectively. The first round cushion has a first center hole. The second round cushion has a second center hole. A first bolt passes through the first center hole to fasten the first round cushion on the hollow upper block. A second bolt passes through the second center hole to fasten the second round cushion on the hollow upper block. A longitudinal plate is disposed on a top of the transverse plate. The longitudinal plate has an upper hole to match the corresponding circular hole and a lower hole to match the corresponding curved hole. A first fastening member passes through the circular hole and the upper hole and a second fastening member passes through the lower hole and the curved hole to fasten the lobe and the longitudinal plate together. A first and a second joints are disposed on the first and the second hollow legs, respectively. Each of the first and the second joints has a threaded lower portion inserted in a top interior of the corresponding hollow leg, an annular flange abutting the threaded lower portion, and a top recess to receive the transverse plate. A bevel is disposed beneath the top recess. A notch is formed on a top rim of the first hollow leg. A third and a fourth fastening members fasten the first and the second joints on the transverse plate. The first brace is fastened on a lower portion of the first hollow leg. The second brace is fastened on a lower portion of the second hollow leg. A first hook extends from a top end of the first bracket to be inserted in the first brace. A second hook extends from a top end of the second bracket to be inserted in the second brace. However, the hollow leg will be detached from the respective joint if the user extends the hollow leg to the utmost.

SUMMARY OF THE INVENTION

An object of the present invention is to provide a musical instrument stand which can be detached easily.

Another object of the present invention is to provide a musical instrument stand which can stand stably.

Another object of the present invention is to provide a musical instrument stand which has a leg support frame having a base bar and the base bar having two end covers to contact the ground so that the musical instrument stand will be positioned stably.

Another object of the present invention is to provide a musical instrument stand which has a nut disposed on a main hollow rod and a collar enclosing the nut in order to protect the nut so that the nut will not be detached from the main hollow rod.

Another object of the present invention is to provide a musical instrument stand which has a generally U-shaped frame having a protrusion to receive an acoustic guitar.

Another object of the present invention is to provide a musical instrument stand which has a generally U-shaped frame having an arm portion to receive an electric guitar.

Another object of the present invention is to provide a musical instrument stand which has a generally U-shaped frame having a hook-shaped portion to receive an electric guitar.

Accordingly, a first musical instrument stand comprises a leg support frame having a base bar and a first leg rod disposed on the base bar, a joint having a first tube connected to the first leg rod, a second tube connected to a second leg rod, and a third tube connected to a third leg rod, and a main hollow rod disposed on the joint. An end portion of an upper rod is inserted in the main hollow rod. A nut is soldered on the main hollow rod. The nut has a threaded hole. A collar has a through hole, a protruded portion defining a slide channel, a through aperture formed on the protruded portion, and the slide channel communicating with the through aperture. The through hole of the collar receives the main hollow rod. The slide channel of the collar receives the nut. The main hollow rod has a circular hole. A bracket has a shaft inserted in the circular hole of the main hollow rod.

Accordingly, a second musical instrument stand comprises a leg support seat having a sleeve, a joint having a first tube connected to a first leg rod, a second tube connected to a second leg rod, and a third tube connected to a third leg rod, and a main hollow rod disposed on the joint. An end portion of an upper rod is inserted in the main hollow rod. The leg support seat has a sleeve having a blind hole to receive the first leg rod, and a pair of pedestals connected to the sleeve. Each of the pedestals has a distal portion. The first leg rod has an end notch. The sleeve has an inner pillar inserted in the end notch of the first leg rod. A collar has a through hole and a protruded portion. The through hole of the collar receives the main hollow rod. The main hollow rod has a circular hole. A bracket has a shaft inserted in the circular hole of the main hollow rod.

DETAILED DESCRIPTION OF THE INVENTION

Figure 1:
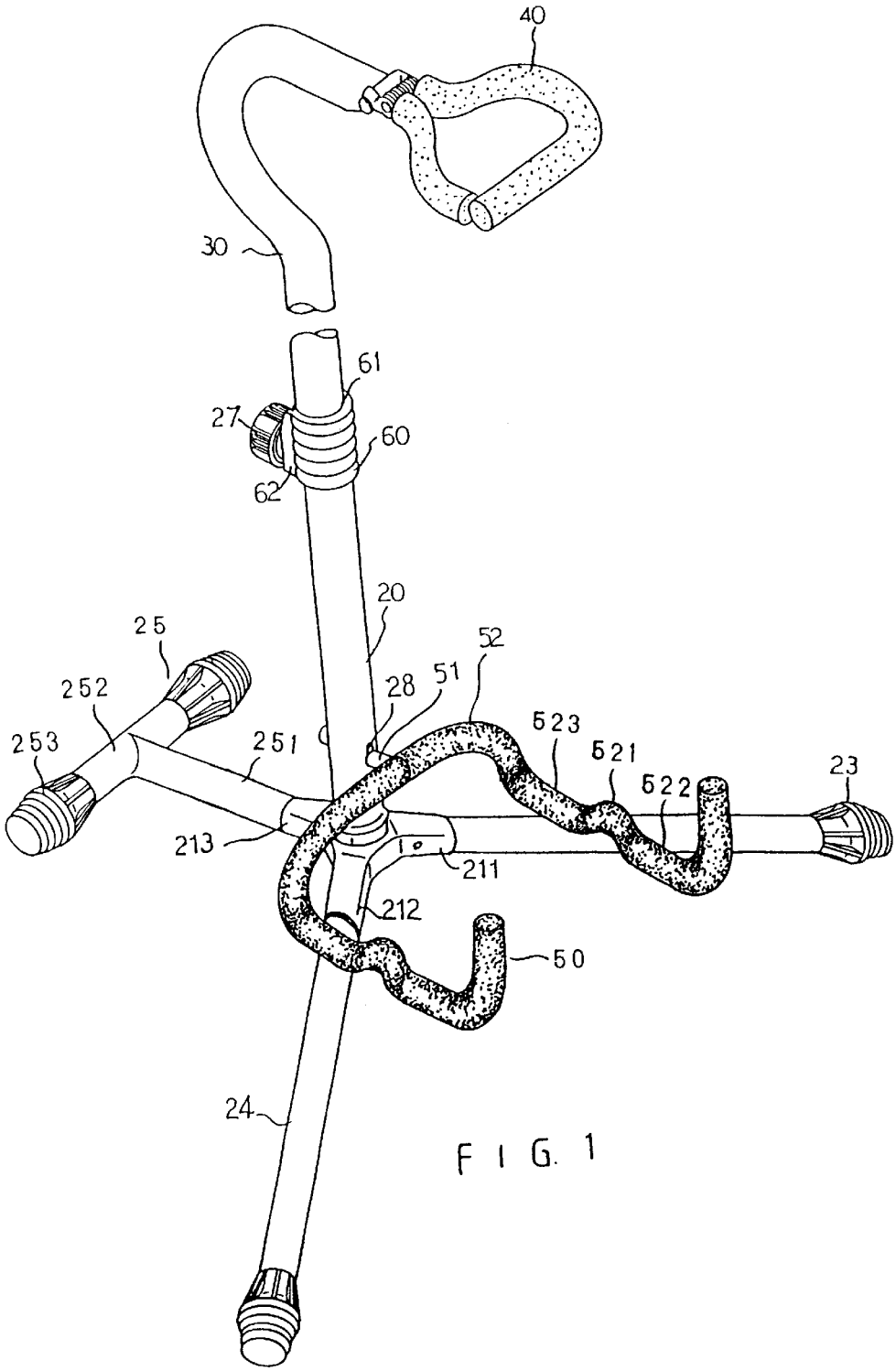
FIG. 1 is a perspective assembly view of a musical instrument stand of a first preferred embodiment in accordance with the present invention.
Figure 2:
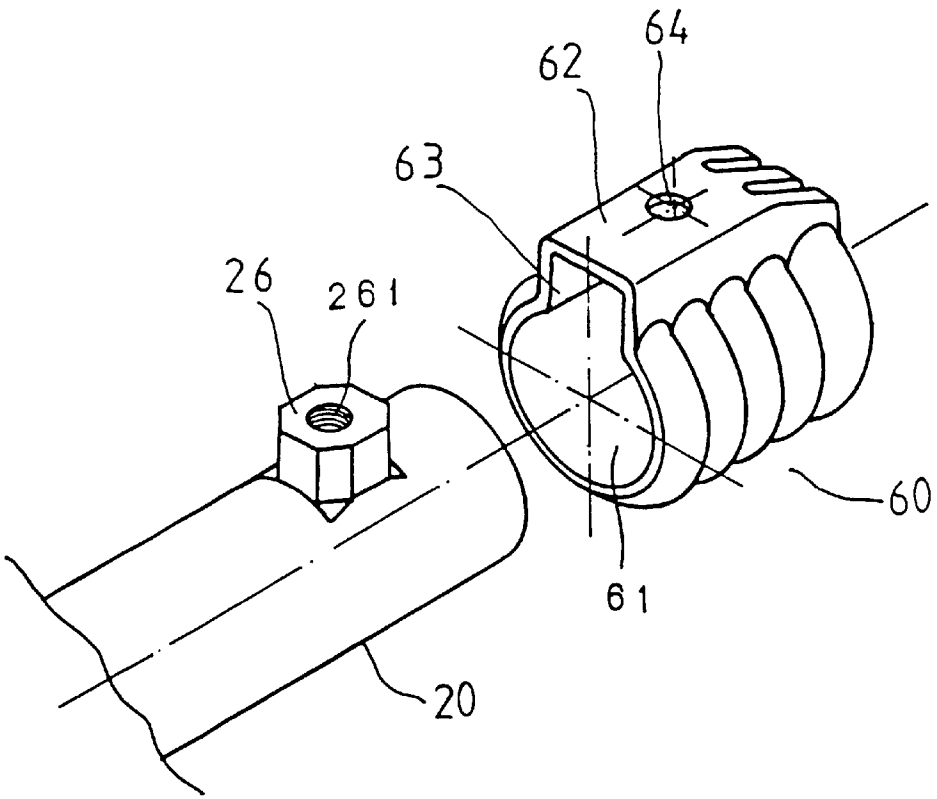
FIG. 2 is a perspective exploded view of a collar and a main hollow rod of a first preferred embodiment in accordance with the present invention.
Figure 3:
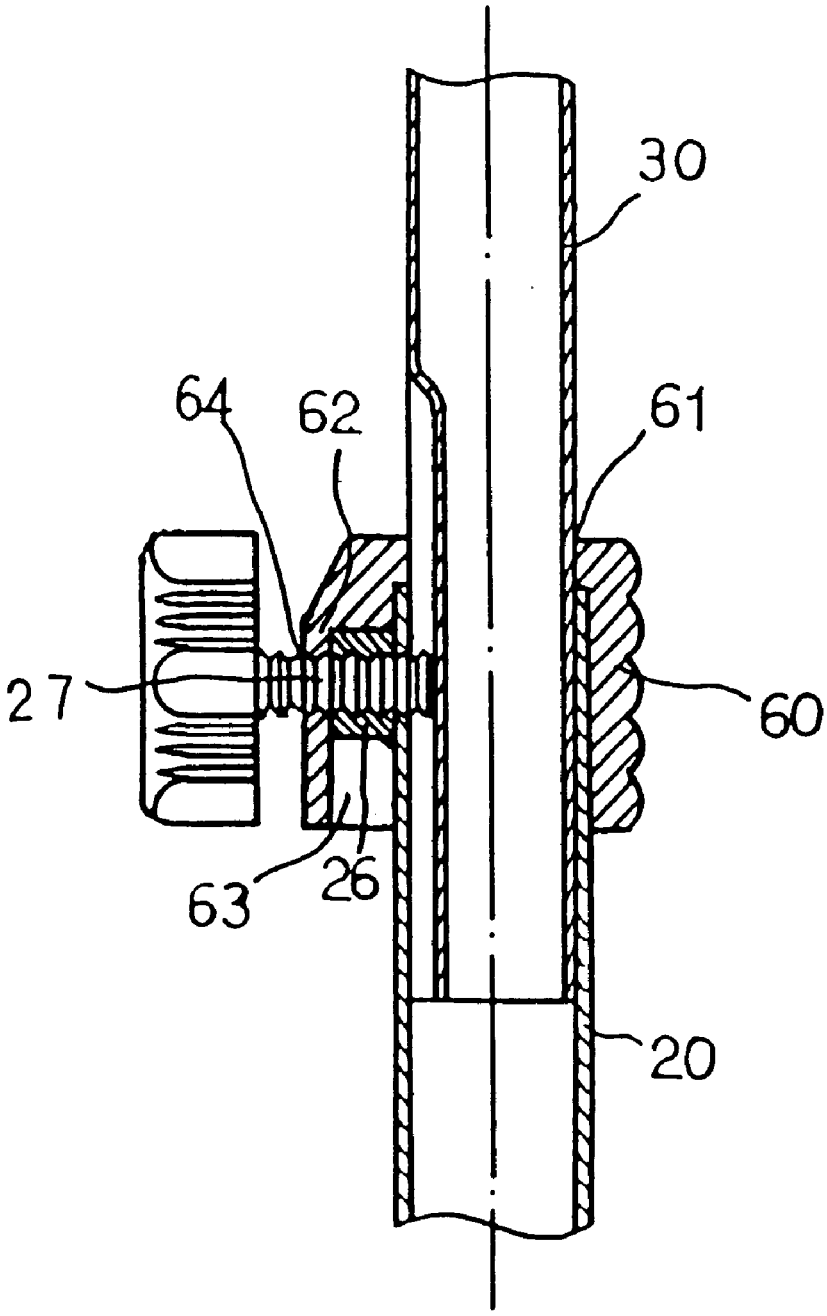
FIG. 3 is a sectional schematic view illustrating a fastening bolt fastening a collar and a main hollow rod of a first preferred embodiment in accordance with the present invention.
Figure 4:
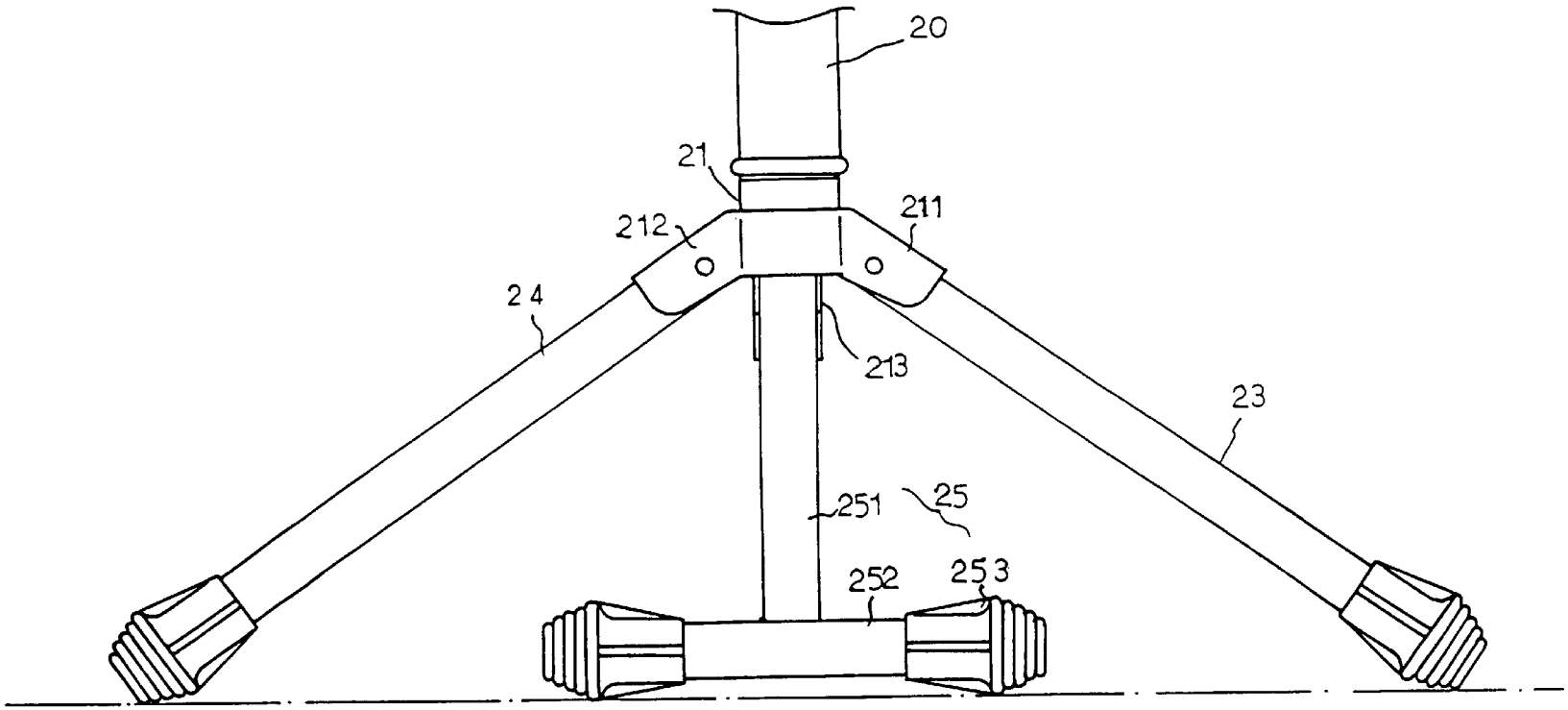
FIG. 4 is an elevational view of a first leg rod, a second leg rod, and a third leg rod of a first preferred embodiment in accordance with the present invention.

Referring to FIGS. 1 to 4, a first musical instrument stand comprises a joint 21, a leg support frame 25 having a base bar 252 and a first leg rod 251 disposed on the base bar 252, the joint 21 having a first tube 213 connected to the first leg rod 251, a second tube 211 connected to a second leg rod 23, and a third tube 212 connected to a third leg rod 24, a main hollow rod 20 disposed on the joint 21, and an upper rod 30.

An end portion of the upper rod 30 is inserted in the main hollow rod 20.

A nut 26 is soldered on the main hollow rod 20.

The nut 26 has a threaded hole 261.

A collar 60 has a through hole 61, a protruded portion 62 defining a slide channel 63, a through aperture 64 formed on the protruded portion 62, and the slide channel 63 communicating with the through aperture 64.

The through hole 61 of the collar 60 receives the main hollow rod 20.

The slide channel 63 of the collar 60 receives the nut 26.

The main hollow rod 20 has a circular hole 28.

A bracket 50 has a shaft 51 inserted in the circular hole 28 of the main hollow rod 20.

The bracket 50 further has a generally U-shaped frame 52 connected to the shaft 51.

The generally U-shaped frame 52 has a pair of arm portions 523, a pair of protrusions 521, a pair of hook-shaped portions 522, each arm portion 523 connected to the corresponding protrusion 521, and each protrusion 521 connected to the corresponding hook-shaped portion 522.

A fastening bolt 27 fastens the collar 60, the nut 26, and the upper rod 30 through the through aperture 64 of the collar 60 and the threaded hole 261 of the nut 26.

Two end covers 253 are disposed on two ends of the base bar 252.

A head brace 40 is connected to the upper rod 30.

Figure 9:
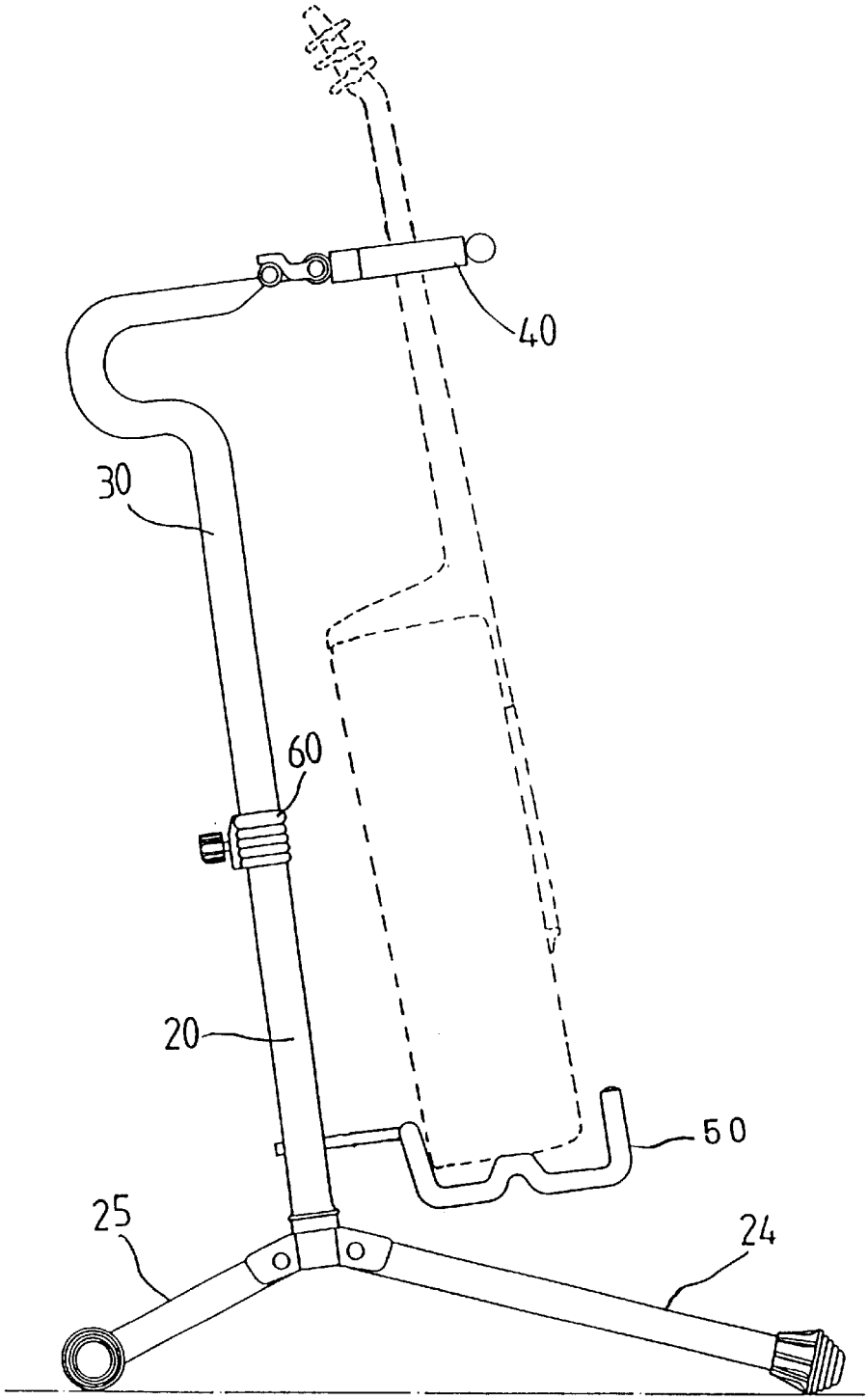
FIG. 9 is a schematic view illustrating an acoustic guitar disposed on a musical instrument stand of a first preferred embodiment in accordance with the present invention.

Referring to FIG. 9, an acoustic guitar is placed on the protrusion 521 of the generally U-shaped frame 52.

Figure 10:
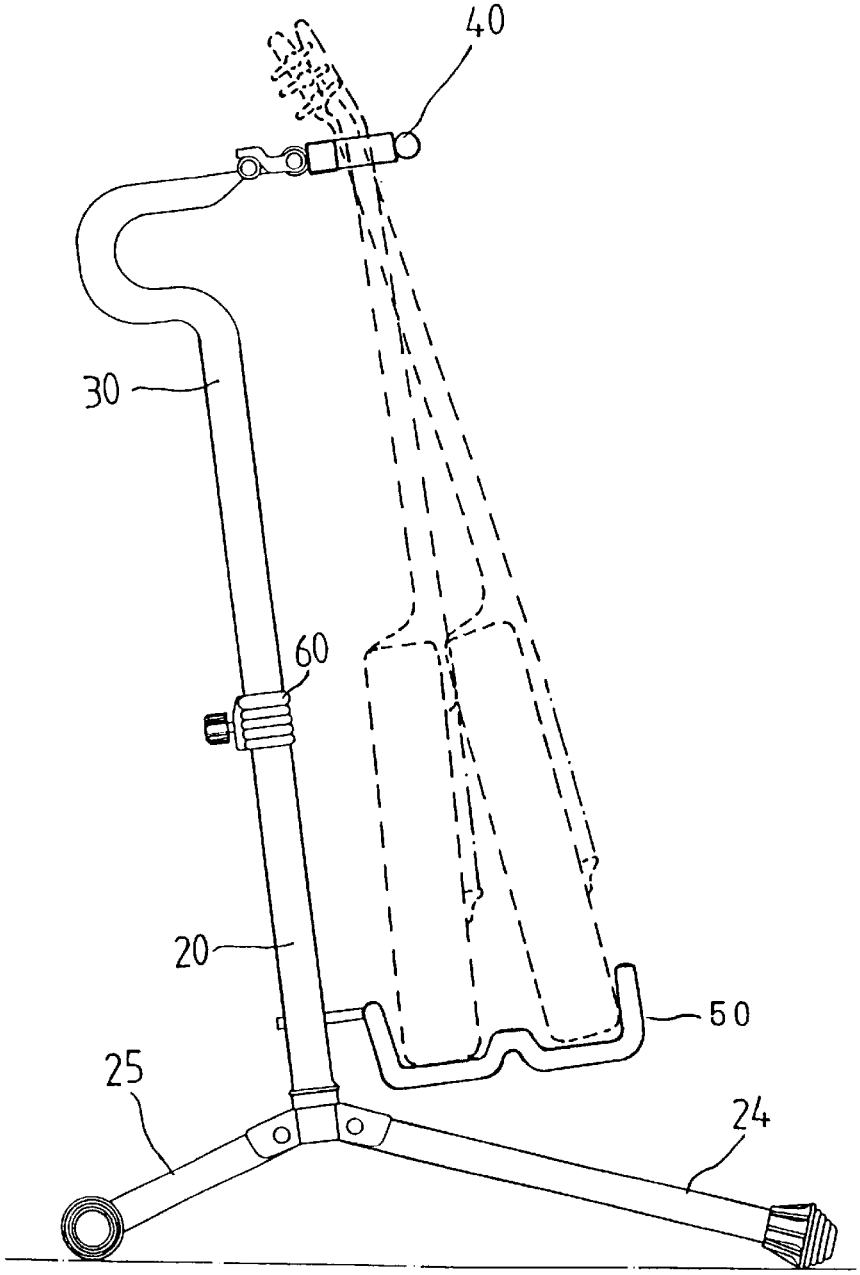
FIG. 10 is a schematic view illustrating an electric guitar disposed on a musical instrument stand of a first preferred embodiment in accordance with the present invention.

Referring to FIG. 10, an electric guitar is placed on the arm portion 523 of the generally U-shaped frame 52 and another electric guitar is placed on the hook-shaped portion 522 of the generally U-shaped frame 52.

Figure 5:
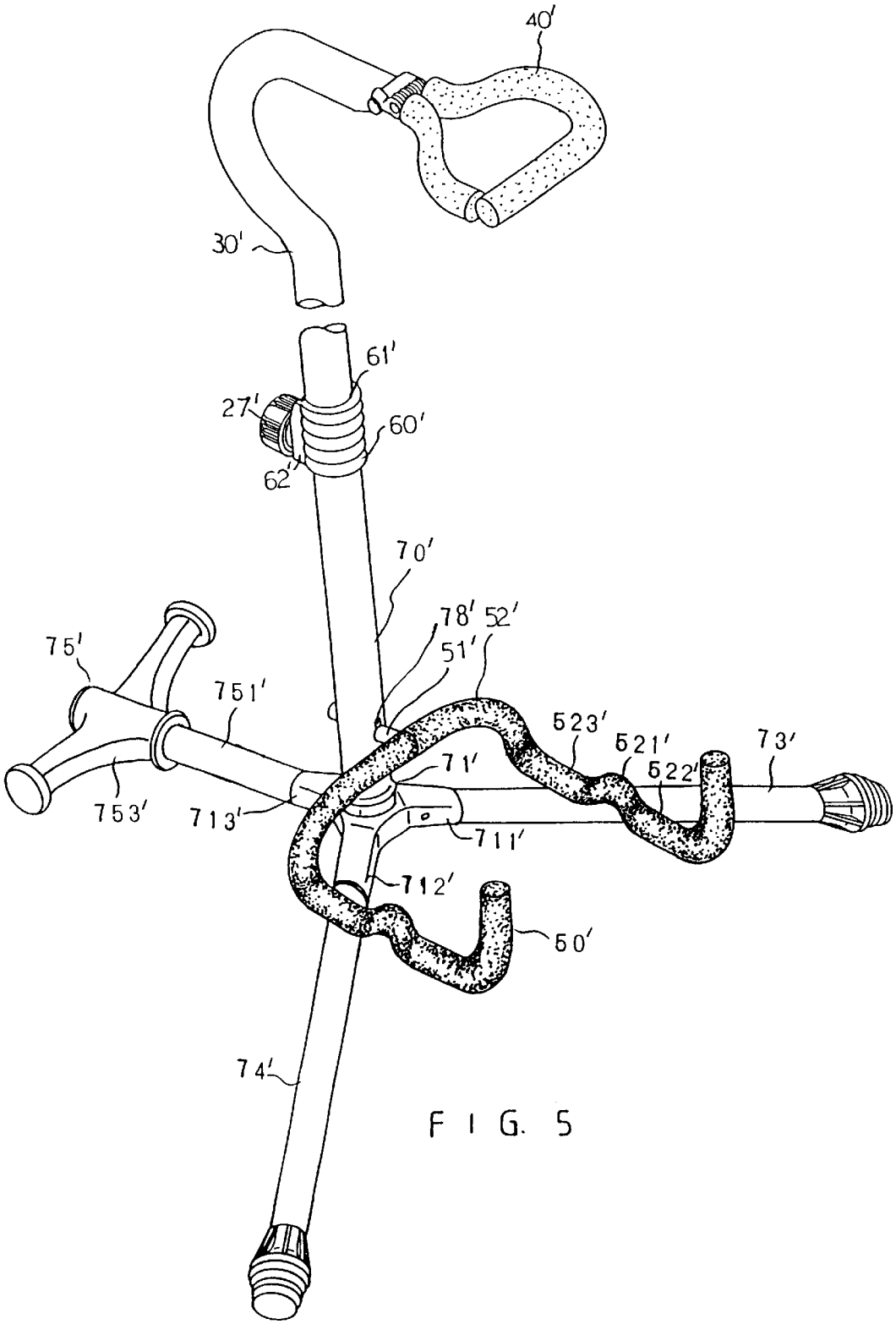
FIG. 5 is a perspective assembly view of a musical instrument stand of a second preferred embodiment in accordance with the present invention.
Figure 6:
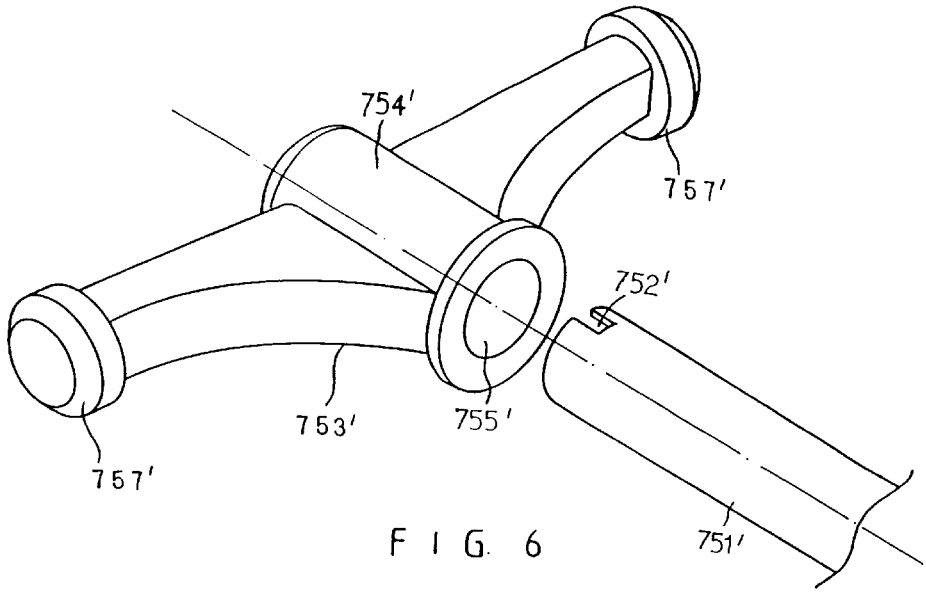
FIG. 6 is a perspective exploded view of a first leg rod and a leg support frame of a second preferred embodiment in accordance with the present invention.
Figure 7:
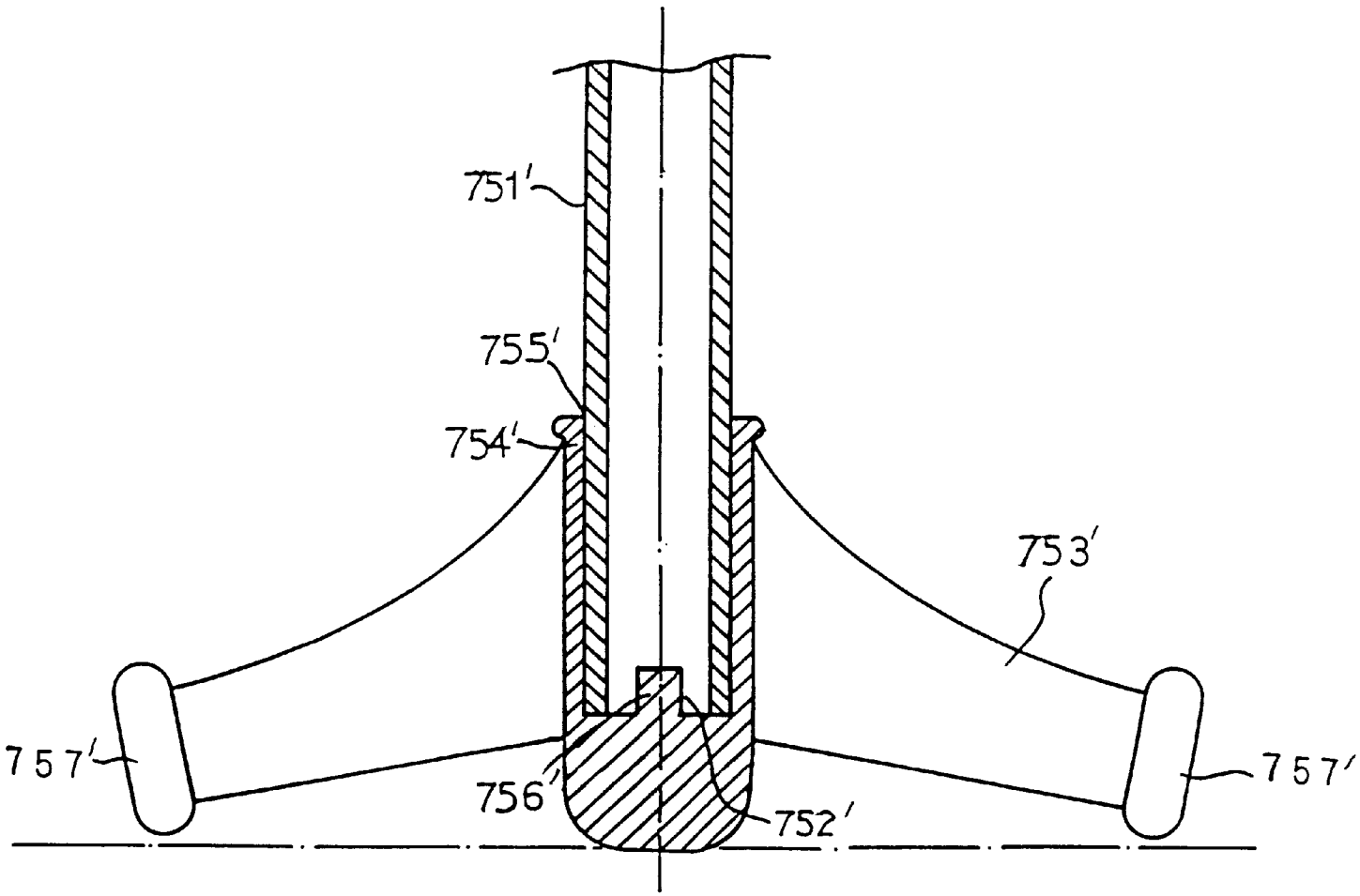
FIG. 7 is a sectional schematic view illustrating a first leg rod engaging with a leg support frame of a second preferred embodiment in accordance with the present invention.
Figure 8:
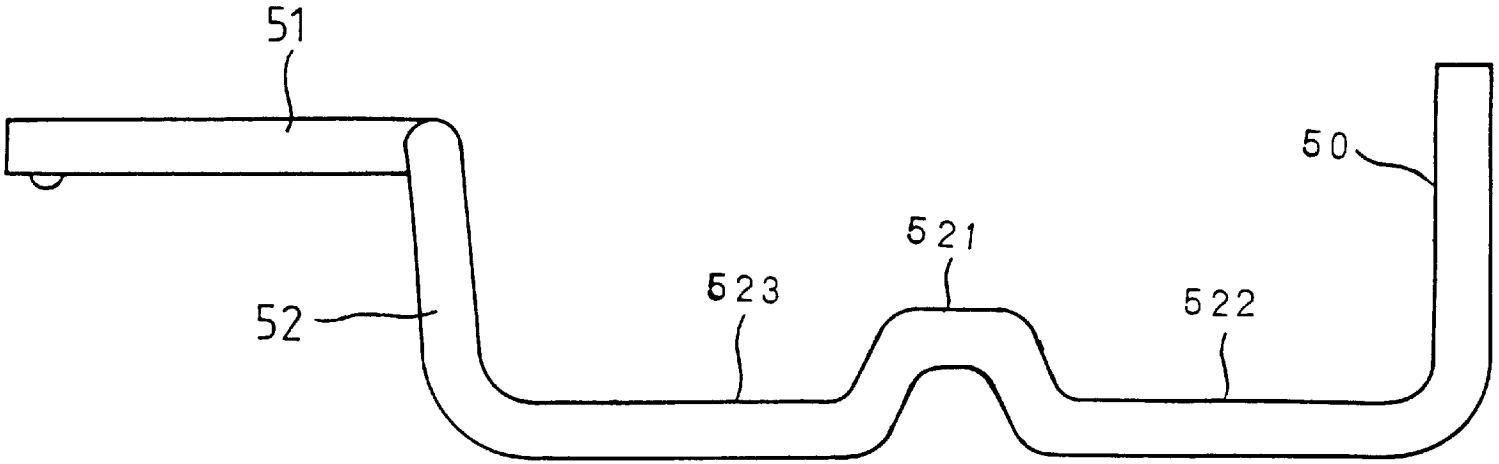
FIG. 8 is an elevational view of a bracket of a first preferred embodiment in accordance with the present invention.

Referring to FIGS. 5 to 7, a second musical instrument stand comprises a joint 71", a leg support seat 75" having a sleeve 754", the joint 71" having a first tube 713" connected to a first leg rod 751", a second tube 711" connected to a second leg rod 73", and a third tube 712" connected to a third leg rod 74", a main hollow rod 70" disposed on the joint 71", and an upper rod 30".

An end portion of the upper rod 30" is inserted in the main hollow rod 70".

The leg support seat 75" has a sleeve 754" having a blind hole 755" to receive the first leg rod 751", and a pair of pedestals 753" connected to the sleeve 754".

Each of the pedestals 753" has a distal portion 757".

The first leg rod 751" has an end notch 752".

The sleeve 754" has an inner pillar 756" inserted in the end notch 752" of the first leg rod 751".

A collar 60" has a through hole 61" and a protruded portion 62".

The through hole 61" of the collar 60" receives the main hollow rod 70".

The main hollow rod 70" has a circular hole 78".

A bracket 50" has a shaft 51" inserted in the circular hole 78" of the main hollow rod 70.

The bracket 50" further has a generally U-shaped frame 52" connected to the shaft 51".

The generally U-shaped frame 52" has a pair of arm portions 523", a pair of protrusions 521", a pair of hook-shaped portions 522", each arm portion 523" connected to the corresponding protrusion 521", and each protrusion 521" connected to the corresponding hook-shaped portion 522".

A fastening bolt 27" fastens the collar 60", the main hollow rod 70", and the upper rod 30".

A head brace 40" is connected to the upper rod 30".

The present invention is not limited to the above embodiments but various modification thereof may be made. Furthermore, various changes in form and detail may be made without departing from the scope of the present invention.

I claim:

1. A musical instrument stand comprises:

a leg support frame having a base bar and a first leg rod disposed on the base bar, a joint having a first tube connected to the first leg rod, a second tube connected to a second leg rod, and a third tube connected to a third leg rod, a main hollow rod disposed on the joint, an end portion of an upper rod inserted in the main hollow rod, a nut soldered on the main hollow rod, the nut having a threaded hole, a collar having a through hole, a protruded portion defining a slide channel, a through aperture formed on the protruded portion, and the slide channel communicating with the through aperture, the through hole of the collar receiving the main hollow rod, the slide channel of the collar receiving the nut, the main hollow rod having a circular hole, and a bracket having a shaft inserted in the circular hole of the main hollow rod.

2. The musical instrument stand as claimed in claim 1, wherein the bracket has a generally U-shaped frame connected to the shaft, and the generally U-shaped frame has a pair of arm portions, a pair of protrusions, a pair of hook-shaped portions, each said arm portion connected to the corresponding protrusion, and each said protrusion connected to the corresponding hook-shaped portion.

3. The musical instrument stand as claimed in claim 1, wherein a fastening bolt fastens the collar, the nut, and the upper rod through the through aperture of the collar and the threaded hole of the nut.

4. The musical instrument stand as claimed in claim 1, wherein two end covers are disposed on two ends of the base bar.

5. The musical instrument stand as claimed in claim 1, wherein a head brace is connected to the upper rod.

6. A musical instrument stand comprises:

a leg support seat having a sleeve, a joint having a first tube connected to a first leg rod, a second tube connected to a second leg rod, and a third tube connected to a third leg rod, a main hollow rod disposed on the joint, an end portion of an upper rod inserted in the main hollow rod, the leg support seat having a sleeve having a blind hole to receive the first leg rod, and a pair of pedestals connected to the sleeve, each of the pedestals having a distal portion, the first leg rod having an end notch, the sleeve having an inner pillar inserted in the end notch of the first leg rod, a collar having a through hole and a protruded portion, the through hole of the collar receiving the main hollow rod, the main hollow rod having a circular hole, and a bracket having a shaft inserted in the circular hole of the main hollow rod.

7. The musical instrument stand as claimed in claim 6, wherein the bracket has a generally U-shaped frame connected to the shaft, and the generally U-shaped frame has a pair of arm portions, a pair of protrusions, a pair of hook-shaped portions, each said arm portion connected to the corresponding protrusion, and each said protrusion connected to the corresponding hook-shaped portion.

8. The musical instrument stand as claimed in claim 6, wherein a fastening bolt fastens the collar, the main hollow rod, and the upper rod.

9. The musical instrument stand as claimed in claim 6, wherein a head brace is connected to the upper rod.

* * * * *